US008147014B2

(12) United States Patent
Muhlburger et al.

(10) Patent No.: US 8,147,014 B2
(45) Date of Patent: Apr. 3, 2012

(54) REFRIGERATING AND/OR FREEZING APPARATUS

(75) Inventors: Martin Muhlburger, Kals (AT); Wolfgang Walder, Oberdrauburg (AT)

(73) Assignee: Liebherr-Hausgerate Lienz GmbH, Lienz (AT)

( * ) Notice: Subject to any disclaimer, the term of this patent is extended or adjusted under 35 U.S.C. 154(b) by 663 days.

(21) Appl. No.: 11/919,860

(22) PCT Filed: May 3, 2006

(86) PCT No.: PCT/EP2006/004126

§ 371 (c)(1), (2), (4) Date: Jan. 12, 2009

(87) PCT Pub. No.: WO2006/117202

PCT Pub. Date: Nov. 9, 2006

(65) Prior Publication Data

US 2009/0251039 A1 Oct. 8, 2009

(30) Foreign Application Priority Data

May 3, 2005 (DE) ..... 20 2005 007 087 U

(51) Int. Cl.
*A47B 96/04* (2006.01)

(52) U.S. Cl. ..... 312/405; 312/329; 16/268

(58) Field of Classification Search ..... 312/405, 312/326–329, 324; 16/268; 62/449; 411/104
See application file for complete search history.

(56) References Cited

U.S. PATENT DOCUMENTS

| | | | | |
|---|---|---|---|---|
| 2,845,320 | A * | 7/1958 | Saunders et al. | 312/204 |
| 3,290,109 | A * | 12/1966 | Vanegas | 312/326 |
| 4,122,581 | A | 10/1978 | Pittasch | |
| 4,774,740 | A * | 10/1988 | Gidseg et al. | 16/344 |
| 4,932,729 | A * | 6/1990 | Thompson et al. | 312/405 |
| 5,568,673 | A * | 10/1996 | Ryczek | 16/244 |
| 5,779,412 | A * | 7/1998 | Nagai et al. | 411/85 |
| 6,070,300 | A | 6/2000 | Shin et al. | |
| 6,146,071 | A * | 11/2000 | Norkus et al. | 411/104 |
| 6,152,554 | A * | 11/2000 | Parisi | 312/405 |
| 6,286,185 | B1 * | 9/2001 | Ramsauer | 16/236 |
| 6,708,374 | B2 * | 3/2004 | Mandel | 16/436 |
| 6,811,363 | B1 * | 11/2004 | Minnich | 411/104 |
| 6,945,621 | B2 * | 9/2005 | Shin | 312/405 |
| 7,555,815 | B2 * | 7/2009 | Tate et al. | 16/309 |
| 7,641,428 | B2 * | 1/2010 | Tucker, II | 411/104 |
| 2003/0151339 | A1 * | 8/2003 | Reed et al. | 312/405 |
| 2005/0262663 | A1 | 12/2005 | Lee | |

FOREIGN PATENT DOCUMENTS

FR 2455157 * 12/1980

* cited by examiner

*Primary Examiner* — Hanh V Tran
(74) *Attorney, Agent, or Firm* — Dilworth & Barrese, LLP

(57) ABSTRACT

A refrigerator and/or freezer is provided with a carcass and door, which by a bearing can be swiveled relative to the carcass of the appliance. The bearing includes a bearing block connected with the carcass of the appliance, a bearing bolt and an adjusting member, preferably an adjusting plate. The bearing block includes at least one recess or bore through which the bearing bolt extends and on whose edge portion the head of the bearing bolt rests. The adjusting member includes a bore with an internal thread and is arranged with the bearing block received between the head of the bearing bolt and adjusting member. The bearing bolt has an external thread which is in engagement with the internal thread of the adjusting member. The recess or bore of the bearing block is configured such that the adjusting member with the bearing bolt is movable relative to the bearing block when the bearing bolt is loosened.

16 Claims, 2 Drawing Sheets

REFRIGERATING AND/OR FREEZING APPARATUS

BACKGROUND OF THE INVENTION

This invention relates to a refrigerator and/or freezer with a carcass and with a door which by means of a bearing can be swivelled relative to the carcass of the appliance.

One problem with a refrigerator and/or freezer of this type consists in that the door must be aligned precisely relative to the carcass of the appliance. Such alignment is required to ensure that in the closed position of the door, the door seal tightly fits in the desired way. Furthermore, a proper alignment ensures that the door is kept in the open condition and does not move any further on its own to be open or closed. Finally, an exact alignment of the door relative to the carcass is desired for optical reasons. In known refrigerators and/or freezers, at least two screws of the lower door bearing must be loosened for this purpose, and subsequently the appliance door, whose weight rests on the lower bearing, must be aligned. Thereafter, the screws are tightened again. The alignment of the appliance door effected in this way is comparatively difficult and complicated.

SUMMARY OF THE INVENTION

Therefore, it is the object of the invention to develop a refrigerator and/or freezer as mentioned above such that the alignment of the appliance door is easily possible.

This object is solved by a refrigerator and/or freezer with the features herein. Accordingly, it is provided that the bearing includes a bearing block connected with the carcass of the appliance, a bearing bolt and an adjusting member, preferably an adjusting plate, wherein the bearing block includes at least one recess or bore through which the bearing bolt extends and on whose edge portion the head of the bearing bolt rests, wherein the adjusting member includes a bore with an internal thread and is arranged such that the bearing block is received between the head of the bearing bolt and the adjusting member, wherein the bearing bolt has an external thread which is in engagement with the internal thread of the adjusting member, and wherein the recess or bore of the bearing block is configured such that the adjusting member with the bearing bolt is movable relative to the bearing block when the bearing bolt is loosened. By means of the arrangement in accordance with the invention it is possible to position the appliance door in the vertical without any major expenditure of time and effort. It is possible to align or adjust the door of the refrigerator or freezer upon loosening a screw, i.e. the bearing bolt, and —as soon as the desired position is reached —fix the same by tightening the screw forming the bearing bolt. For adjusting the door alignment, the bearing bolt must only be loosened or unscrewed to such an extent that the adjusting member and hence also the bearing bolt can be moved laterally. It is not necessary to completely remove the bearing bolt.

The adjusting member can be a plate. Any other shapes of the adjusting member are, however, also conceivable and comprised by the invention.

In a preferred aspect of the invention, the bearing block includes a toothed or roughened portion on the inner surface facing the adjusting member, against which rests the adjusting member. The toothed or roughened portion effects that an undesired displacement of the adjusting member relative to the bearing block is prevented due to the increased friction between bearing block and adjusting member. Alternatively or in addition, it can be provided that on its side facing the bearing block the adjusting member includes a toothed or roughened portion against which rests the bearing block. An undesired displacement is of course prevented particularly effectively when both the bearing block on its side facing the adjusting member and the adjusting member on its side facing the bearing block includes a toothed or roughened portion. Preferably, the toothed portion of the adjusting member engages in the toothed portion of the bearing block.

Furthermore, it can be provided that the bearing block includes one, two or more than two bores for receiving the bearing bolt, and that the one or more bores are configured as oblong holes. When the bearing bolt is shifted in the oblong hole, this leads to a corresponding change in the position of the bearing bolt and thus also of the door relative to the carcass of the refrigerator or freezer. It is conceivable that two such oblong holes are provided one beside the other, so that the bearing block can be used both with doors with right-hand stop and with doors with left-hand stop.

In a preferred aspect of the invention it is provided that the bearing block includes at least one groove, in which the adjusting member or the adjusting plate is inserted and which has such a length that the adjusting member can be moved in different positions relative to the groove and thus to the bearing block.

To prevent the adjusting member from falling out of the bearing block, it can be provided that the groove walls of the groove are inclined towards the open side of the groove such that the groove width is reduced proceeding from the groove base to the open side of the groove. The groove walls can extend towards each other at an angle. Particularly advantageously, the adjusting member includes side walls complementary to the groove walls, i.e. likewise extending at an angle. Other configurations of groove and adjusting member are of course also conceivable.

To be able to use the bearing block both with doors with right-hand stop and with doors with left-hand stop, it can be provided that the bearing block includes two grooves, into which the adjusting member can be inserted from the one or the other side of the bearing block.

The adjusting member has the function of fixing the bearing bolt relative to the bearing block in the desired position. For this purpose it is provided that the bearing bolt includes a threaded portion which at least in a certain region is in engagement with the internal thread of the adjusting member. Another function of the bearing bolt consists in pivotally mounting the door of the appliance. For this purpose it is provided that the bearing bolt includes a further portion without thread, on which the door is mounted with a corresponding recess or bushing.

In a further aspect of the invention it is provided that the bearing block has an L-shaped design, wherein the one leg includes bores for receiving fastening screws by means of which the bearing block is mounted on the carcass, and wherein the other leg includes the at least one bore for receiving the bearing bolt. With one of its legs, the bearing block preferably is mounted on the front side of the carcass of the appliance. The bearing bolt preferably extends vertically through the bore or recess of the other leg of the bearing block, which in a preferred aspect extends horizontally from the carcass of the appliance.

The bearing with bearing block, bearing bolt and adjusting member can be located on the upper surface and/or on the lower surface of the carcass of the appliance. An arrangement on the upper surface of the carcass or door is particularly advantageous. When the bearing bolt is loosened, it prevents the door from tilting forward, as it is still retained in its position by the bearing bolt.

BRIEF DESCRIPTION OF THE DRAWINGS

Further details and advantages of the invention will be explained in detail with reference to an embodiment illustrated in the drawing, in which.

DESCRIPTION OF THE PREFERRED EMBODIMENTS

Figure 1:
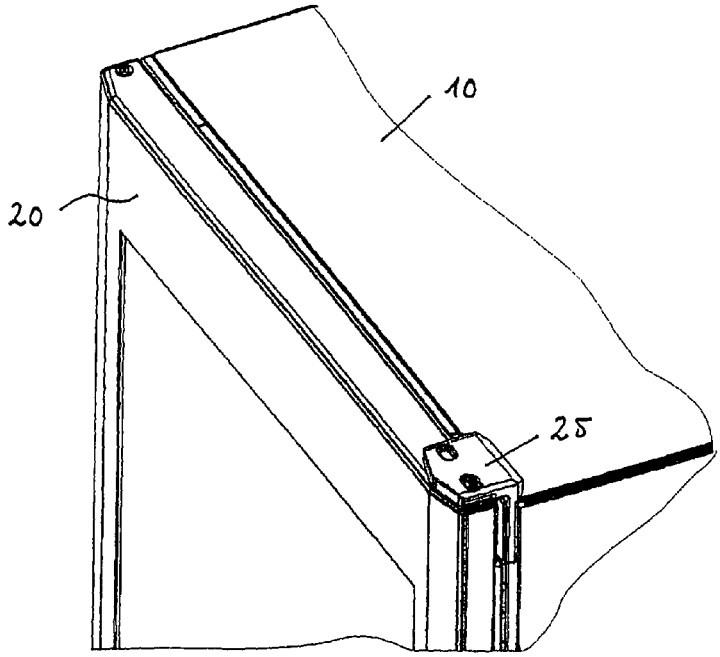
FIG. 1: shows a perspective view of the upper region of appliance carcass and door with upper door bearing.

FIG. 1 shows a perspective view of the upper region of a refrigerator and/or freezer with appliance housing or carcass 10, whose inside container defining the cooling or freezing space is closed by the door 20. In the upper and lower terminal region of the carcass 10, there is each provided a door bearing about which the door 20 can be swivelled, and in FIG. 1, the upper door bearing is provided with the reference numeral 25. The design of the lower door bearing can differ from the design of the upper door bearing or correspond to the design thereof.

Figure 2:
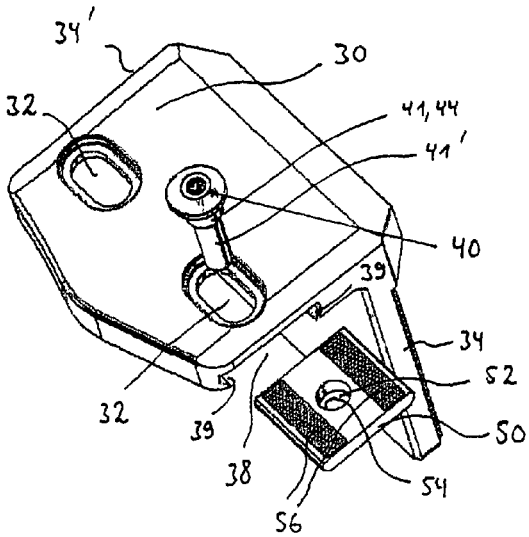
FIG. 2: shows a perspective view of the bearing block with bearing bolt and adjusting plate in the exploded condition obliquely from the top.

The design of the door bearing 25 is shown in FIG. 2. The door bearing 25 consists of the bearing block 30, the bearing bolt 40 and the adjusting plate 50.

The bearing block 30 is L-shaped in cross-section, wherein the one leg 34 includes bores 35. The same serve to receive fastening screws, by means of which the leg 34 of the bearing block 30 is mounted on the front side of the carcass 10 of the appliance, as shown in FIG. 1. The other leg 34' extends at right angles to the leg 34 and extends in horizontal direction. As shown in FIG. 1, the upper surface of the horizontal leg 34' is not aligned with the upper surface of the carcass 10 of the appliance, but protrudes beyond the same. The lower surface of the horizontal leg 34' approximately is aligned with the upper surface of the carcass 10 of the appliance, so that the door 20 adjoining the lower surface of the horizontal leg 34' also terminates with the upper surface of the carcass 10 of the appliance.

Figure 3:
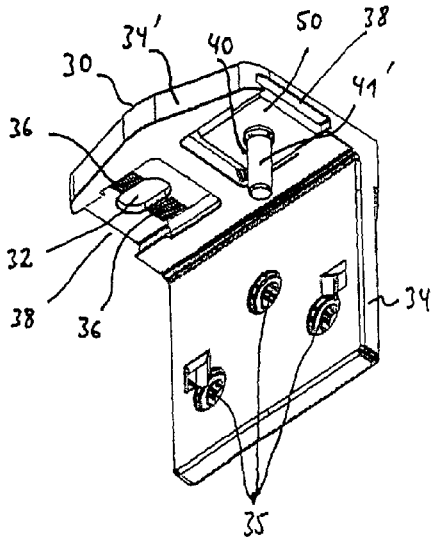
FIG. 3: shows a perspective view of the bearing block with bearing bolt and adjusting plate in the mounted condition obliquely from below.

As can be taken from FIGS. 2 and 3, two bores 32 configured as oblong holes extending in lateral direction are provided in the horizontal leg 34' of the bearing block 30, which are arranged one beside the other. Depending on whether the door is mounted with right-hand or left-hand stop, one of the oblong holes, namely the oblong hole directed towards the outside of the appliance, is utilized for receiving the bearing bolt, whereas the other one remains clear.

The screw serving as bearing bolt 40 extends through the bore 32 configured as oblong hole, which screw has an external thread 44 in its terminal region directed towards the screw head and in the adjoining portion 41' is configured without thread. For actuating the screw or the bearing bolt 40, a socket for receiving a tool is provided in its head.

In the case of an upper door bearing, the bearing bolt 40 is passed from the top through the bore 32 of the bearing block 30. In the mounted condition, the head of the bearing bolt 40 is seated on the upper surface of the horizontal leg 34' of the bearing block 30 or on the edge portion of the bore 32. On the lower surface of the horizontal leg 34' of the bearing block 30 the grooves 38 are located. In the mounted condition of the bearing block 30, the adjusting plate 50 is inserted in one of the grooves 38, which adjusting plate includes a bore 52 with internal thread 54. The external thread 44 of the bearing bolt 40 engages in the internal thread 54 of the bore of the adjusting plate 50.

When the bearing bolt 40 is tightened by means of the adjusting plate 50, the bearing bolt 40, the adjusting plate 50 and the bearing block 30 are not movable relative to each other, and the door 20 is fixed in the desired position or alignment.

Figure 4:
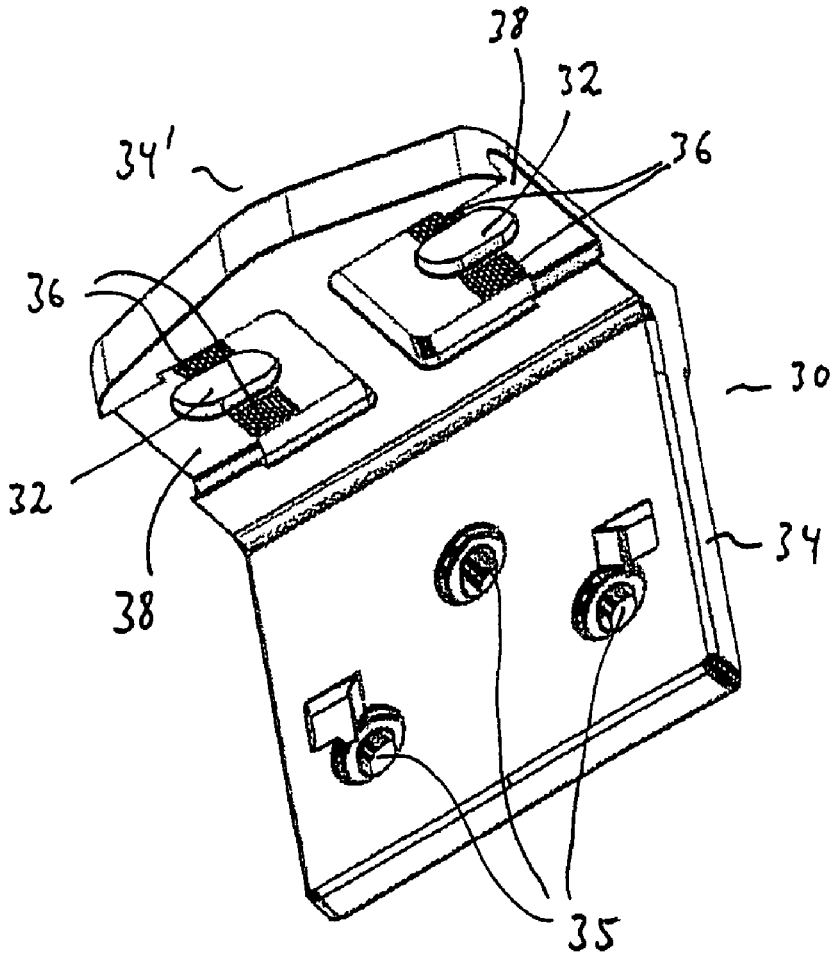
FIG. 4: shows a perspective view of the bearing block obliquely from below.
Figure 5:
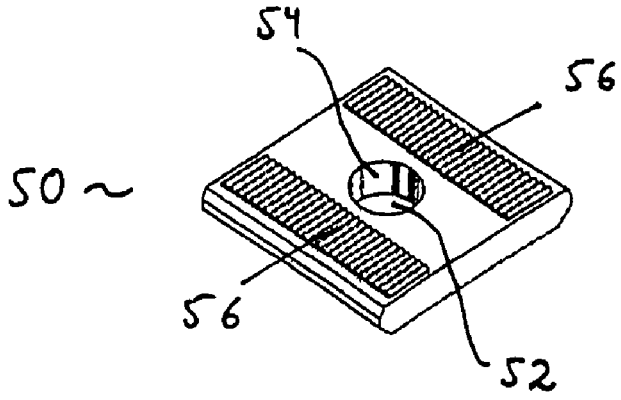
FIG. 5: shows a perspective view of the adjusting plate.

To prevent an undesired slipping of the adjusting plate 50 with bearing bolt 40 relative to the bearing block 30, the adjusting plate 50 has a toothed portion 56 on its side facing the bearing block 30, which extends on both sides of the bore 52 of the adjusting plate 50, as can also be taken from FIG. 5. Furthermore, on the side of the bearing block 30 facing the adjusting plate 50 there is likewise provided a toothed portion 36, which extends on both sides of the bores 32 of the bearing block 30 and meshes with the toothed portion 56 of the adjusting plate 50. The toothed portion 36 of the bearing block 30 is shown in FIGS. 3 and 4. The toothed portion 56 of the adjusting plate 50 and the toothed portion 36 of the bearing block 30 are aligned such that the undesired movement of the adjusting plate 50 in the groove 38 of the bearing block 30 is inhibited, which has the advantage that an undesired movement of the door 20 upon alignment thereof can be inhibited.

As stated above, the bearing bolt 40 includes a threaded portion 41 with a thread 44, by means of which the bearing bolt 40 is screwed to the adjusting plate 50 for the purpose of fixing the relative position of bearing bolt 40 and bearing block 30, wherein in this region the bearing block 30 is received between bearing bolt 40 and adjusting plate 50. The bearing bolt 40 includes a portion 41' without thread adjoining the threaded portion 41, which serves as bearing and which engages in a corresponding bore on the upper surface of the door.

As can be taken for instance from FIG. 2, the bearing block 30 includes two bores 32 disposed one beside the other -for receiving the bearing bolt 40. As can be taken from FIG. 3, a groove 38 is associated to each of the bores 32, in which the adjusting plate 50 is inserted. Such configuration of the bearing block 30 has the advantage that one and the same bearing block can be used both for the right-hand stop and for the left-hand stop, wherein in both cases (right-hand stop and left-hand stop) the bore 32 directed towards the outer edge of the door 20 and the groove 38 for receiving the bearing bolt are 40 and the adjusting plate 50 are used.

Mounting the door 20 in the desired position is effected as follows:

The bearing bolt 40 is unscrewed to such an extent that the adjusting plate 50 can be moved laterally in the groove 38. It is not necessary to completely remove the bearing bolt 30. This provides the advantage that the door 20 cannot tilt forward, as it is still retained in its position by the bearing bolt 30.

The door 20 is mounted vertically. As the bearing bolt 40 is connected with the adjusting plate 50 by means of the above-mentioned thread, the two parts, i.e. the bearing bolt 40 and the adjusting plate 50, move into the proper position with the door 20.

As soon as the desired position is reached, the bearing bolt is tightened again.

If a change of the door-stop (from right-hand stop to left-hand stop or vice versa) should be effected, the adjusting plate 50 must be inserted from the other side, i.e. into the other groove 38 of the bearing block 30.

The invention claimed is:

1. A refrigerator and/or freezer with a carcass (10) and door (20), which by a bearing can be swivelled relative to the carcass (10) of the refrigerator and/or freezer, wherein the bearing includes a bearing block (30) connected with the carcass (10) of the refrigerator and/or freezer, a bearing bolt (40), and an adjusting plate member (50), the bearing block (30) includes at least one elongated recess or bore (32) extending horizontally in a lateral direction along the front of the carcass and through which the bearing bolt (40) extends and on whose edge portion the head of the bearing bolt (40) rests, the adjusting member includes a bore (52) with an internal thread (54) and is arranged such that the bearing block (30) is received between the head of the bearing bolt (40) and the adjusting member, the bearing bolt (40) has an external thread (44) which is in engagement with the internal thread (54) of the adjusting member, and the recess or bore (32) of the bearing block (30) is configured such that the adjusting member with the bearing bolt (40) laterally is movable relative to the bearing block (30) along the elongated recess or bore for adjusting the door alignment along the front of the carcass when the bearing bolt (40) is loosened, wherein the bearing block (30) includes at least one groove (38), in which the adjusting member is movably received when the bearing bolt (40) is loosened.

2. The refrigerator and/or freezer according to claim 1, wherein on its side facing the adjusting member, the bearing block (30) includes a toothed portion (36) or a roughened portion, against which rests the adjusting member.

3. The refrigerator and/or freezer according to claim 1, wherein on its side facing the bearing block (30) the adjusting member includes a toothed portion (56) or a roughened portion, against which rests the bearing block (30).

4. The refrigerator and/or freezer according to claim 1, wherein the bearing block (30) includes one, two or more than two bores (32) for receiving the bearing bolt (40), and that the one or more bores (32) are configured as oblong holes.

5. The refrigerator and/or freezer according to claim 1, wherein groove walls (39) of the groove (38) are inclined towards the open side of the groove (38) such that the groove width is reduced proceeding from the groove base to the open side of the groove (38).

6. The refrigerator and/or freezer according to claim 1, wherein the bearing block (30) includes two grooves (38), into each of which the adjusting member can laterally be inserted.

7. The refrigerator and/or freezer according to claim 1, wherein the bearing bolt (40) includes a further portion (41') without thread, on which the door (20) is mounted.

8. The refrigerator and/or freezer according to claim 1, wherein the bearing block (30) has an L-shaped design, wherein one leg (34) includes bores (35) for receiving fastening screws, by means of which the bearing block (30) is mounted on the carcass (10), and the other leg (34') includes the at least one recess or bore (32) for receiving the bearing bolt (40).

9. The refrigerator and/or freezer according to claim 1, wherein the bearing with bearing block (30), bearing bolt (40) and adjusting member is located on the upper surface or on the lower surface of the door (20) of the appliance.

10. The refrigerator and/or freezer according to claim 2, wherein on its side facing the bearing block (30) the adjusting member includes a toothed portion (56) or a roughened portion, against which rests the bearing block (30).

11. The refrigerator and/or freezer according to claim 10, wherein the bearing block (30) includes one, two or more than two bores (32) for receiving the bearing bolt (40), and the one or more bores (32) are configured as oblong holes.

12. The refrigerator and/or freezer according to claim 2, wherein the bearing block (30) includes one, two or more than two bores (32) for receiving the bearing bolt (40), and the one or more bores (32) are configured as oblong holes.

13. The refrigerator and/or freezer according to claim 3, wherein the bearing block (30) includes one, two or more than two bores (32) for receiving the bearing bolt (40), and the one or more bores (32) are configured as oblong holes.

14. The refrigerator and/or freezer according to claim 3, wherein the groove walls (39) of the groove (38) are inclined towards the open side of the groove (38) such that the groove width is reduced proceeding from the groove base to the open side of the groove (38).

15. The refrigerator and/or freezer according to claim 13, wherein the groove walls (39) of the groove (38) are inclined towards the open side of the groove (38) such that the groove width is reduced proceeding from the groove base to the open side of the groove (38).

16. The refrigerator and/or freezer according to claim 12, wherein the groove walls (39) of the groove (38) are inclined towards the open side of the groove (38) such that the groove width is reduced proceeding from the groove base to the open side of the groove (38).

* * * * *